US005789367A

United States Patent [19]

Blokzijl et al.

[11] Patent Number: 5,789,367

[45] Date of Patent: *Aug. 4, 1998

[54] DETERGENT COMPOSITIONS CONTAINING SOIL RELEASE POLYMERS

[75] Inventors: Wilfried Blokzijl, Amsterdam, Netherlands; Andrew Martin Creeth, Cheshire, United Kingdom; Andrew David Green, Liverpool, United Kingdom; Michael Hull, Gwynedd, United Kingdom

[73] Assignee: Lever Brothers Company, Division of Conopco, Inc., New York, N.Y.

[ * ] Notice: The term of this patent shall not extend beyond the expiration date of Pat. No. 5,789,366.

[21] Appl. No.: 755,511

[22] Filed: Nov. 22, 1996

[30] Foreign Application Priority Data

Nov. 30, 1995 [GB] United Kingdom ..... 9524488

[51] Int. Cl.[6] ..... C11D 3/37

[52] U.S. Cl. ..... 510/292; 510/299; 510/300; 510/302

[58] Field of Search ..... 510/292, 299

[56] References Cited

U.S. PATENT DOCUMENTS

| | | | |
|---|---|---|---|
| 4,714,479 | 12/1987 | Wilsberg | 510/292 |
| 4,721,580 | 1/1988 | Gosselink | 510/299 |
| 5,047,165 | 9/1991 | Lsly et al. | 510/292 |
| 5,196,133 | 3/1993 | Leslie et al. | 510/299 |
| 5,599,782 | 2/1997 | Pan et al. | 510/299 |

FOREIGN PATENT DOCUMENTS

| | | |
|---|---|---|
| 001 305 | 4/1979 | European Pat. Off. . |
| 164 514 | 12/1985 | European Pat. Off. . |
| 185 427 | 6/1986 | European Pat. Off. . |
| 199 403 | 10/1986 | European Pat. Off. . |
| 241 984 | 10/1987 | European Pat. Off. . |
| 241 985 | 10/1987 | European Pat. Off. . |
| 272 033 | 6/1988 | European Pat. Off. . |
| 311 342 | 4/1989 | European Pat. Off. . |
| 340 013 | 11/1989 | European Pat. Off. . |
| 280 | 3/1990 | European Pat. Off. . |
| 357 280 | 3/1990 | European Pat. Off. . |
| 367 339 | 5/1990 | European Pat. Off. . |
| 384 070 | 8/1990 | European Pat. Off. . |
| 390 251 | 10/1990 | European Pat. Off. . |
| 420 317 | 4/1991 | European Pat. Off. . |
| 502 675 | 9/1992 | European Pat. Off. . |
| 576 777 | 1/1994 | European Pat. Off. . |
| 1 437 950 | 6/1976 | United Kingdom . |
| 1 467 098 | 3/1977 | United Kingdom . |
| 1 470 250 | 4/1977 | United Kingdom . |
| 1 473 202 | 5/1977 | United Kingdom . |
| WO 92/04433 | 3/1992 | WIPO . |
| WO 93/21294 | 10/1993 | WIPO . |
| WO94/03570 | 2/1994 | WIPO . |
| WO 94/22937 | 10/1994 | WIPO . |
| WO 95/02029 | 1/1995 | WIPO . |
| WO 95/32997 | 12/1995 | WIPO . |

OTHER PUBLICATIONS

Derwent Abstract of WO 95/32997.
Derwent Abstract of EP 164 514.

*Primary Examiner*—Ellen M. McAvoy
*Attorney, Agent, or Firm*—Rimma Mitelman

[57] ABSTRACT

A laundry detergent composition contains organic surfactant, zeolite MAP builder, and a soil release polymer which is a defined water-soluble or water-dispersible sulphonated non-end-capped polyester, for example, of terephthalic acid, isophthalic acid, sulphoisophthalic acid and ethylene glycol.

9 Claims, No Drawings

DETERGENT COMPOSITIONS CONTAINING SOIL RELEASE POLYMERS

TECHNICAL AREA

The present invention relates to laundry detergent compositions containing certain water-soluble or water-dispersible polymers exhibiting improved soil release properties.

BACKGROUND AND PRIOR ART

Polyesters of terephthalic and other aromatic dicarboxylic acids having soil release properties are widely disclosed in the art, in particular, the so-called PET/POET (polyethylene terephthalate/polyoxyethylene terephthalate) and PET/PEG (polyethylene terephthalate/polyethylene glycol) polymers which are disclosed, for example, in U.S. Pat. No. 3,557,039 (ICI), GB 1 467 098 and EP 1305A (Procter & Gamble). Polymers of this type are available commercially, for example, as Permalose, Aquaperle and Milease (Trade Marks) (ICI) and Repel-O-Tex (Trade Mark) SRP3 (Rhône-Poulenc). Other patent publications disclosing soil release polymers which are condensation products of aromatic dicarboxylic acids and dihydric alcohols include EP 185 427A, EP 241 984A, EP 241 985A and EP 272 033A (Procter & Gamble).

EP 357 280A (Procter & Gamble) discloses sulphonated end-capped linear terephthalate oligomers which are condensation products of a low molecular weight diol, preferably propylene glycol or ethylene glycol, with terephthalic acid.

The present invention is based on the use of a class of non-end-capped sulphonated polyesters based on dicarboxylic acids and polyols which provide especially effective soil release, especially from polyester fabrics, and which are also effective in reducing soil redeposition in the wash.

DEFINITION OF THE INVENTION

The present invention accordingly provides a detergent composition for washing fabrics, comprising (a) from 2 to 50 wt % of an organic surfactant system comprising one or more anionic, nonionic, cationic, amphoteric or zwitterionic surfactants;

(b) from 5 to 80 wt % of a builder component comprising zeolite P having a silicon to aluminium ratio not exceeding 1.33 (zeolite MAP);

(c) a soil release effective amount of a water-soluble or water-dispersible sulphonated polyester comprising monomer units of (i) an unsulphonated aromatic diacidic monomer (A), (ii) a sulphonated aromatic diacidic monomer (SA)

(iii) optionally a hydroxylated aromatic or aliphatic diacidic monomer (HA), in an amount replacing up to 50 mole % of (A) and/or (SA), (iv) a polyol (P) selected from ethylene glycol, propylene glycol, isopropylene glycol, glycerol, 1,2,4-butanetriol and 1,2,3-butanetriol, and oligomers of these having from 1 to 8 monomer units, the polyester having a sulphur content within the range of from 0.5 to 10 wt %;

(d) optionally other detergent ingredients to 100 wt %.

DETAILED DESCRIPTION OF THE INVENTION

The Polyesters

The polyesters with which the invention is concerned are defined above. The polyesters and their preparation are disclosed and claimed in WO 95 32997A (Rhône-Poulenc).

Preferred polyesters have the following features:

the unsulphonated diacidic monomer (A) is an aromatic dicarboxylic acid or an anhydride of a lower ($C_1$–$C_4$) alkyl diester thereof, selected from terephthalic acid, isophthalic acid, 2,6-naphthalene dicarboxylic acid, anhydrides and lower ($C_1$–$C_4$) alkyl diesters thereof;

the sulphonated diacidic monomer (SA) is a sulphonated aromatic dicarboxylic acid, anhydride, or lower ($C_1$–$C_4$) alkyl diester thereof;

the mole ratio (A):[(A)+(SA)] is within the range of from 60:100 to 95:100, preferably from 65:100 to 93:100;

the mole ratio (SA):[(A)+(SA)] is within the range of from 5:100 to 40:100, preferably from 7:100 to 35:100;

the hydroxylated monomer (HA), if present, is a hydroxylated aromatic dicarboxylic acid, or anhydride or lower ($C_1$–$C_4$) dialkyl ester thereof;

the hydroxylated monomer (HA), if present, does not replace more than 30 mole % of (A) and/or (SA);

the quantity of (P) is such that the ratio of OH functional groups of (P) to COOH functional groups (or equivalents) of (A)+(SA)+any (HA) is within the range of from 1.05:1 to 4:1, preferably from 1.1:1 to 3.5:1, and more preferably from 1.8:1 to 3:1;

the polyester has a number average molecular weight of less than 20,000, the sulphur content is within the range of from 1.2 to 8 wt %;

the hydroxyl group content is at least 0.2 OH equivalent per kg of polyester.

The Unsulphonated Diacidic Monomer (A)

As previously indicated, the monomer (A) preferably consists of at least one dicarboxylic acid or anhydride chosen from terephthalic, isophthalic and 2,6 naphthalene-dicarboxylic acids or anhydrides or their diesters.

Preferably, monomer (A) is present in a quantity corresponding to a molar ratio (A)/[(A)+(SA)] within the range of from 95:100 to 60:100, preferably from 93:100 to 65:100.

The unsulphonated diacidic monomer (A) preferably consists of 50 to 100 mole %, more preferably 70 to 90 mole %, of terephthalic acid or anhydride or lower alkyl (methyl, ethyl, propyl, isopropyl, butyl) diester, and of 0 to 50 mole %, more preferably from 10 to 30 mole %, of isophthalic acid or anhydride and/or of 2,6-naphthalenedicarboxylic acid or anhydride or lower alkyl (methyl, ethyl, propyl, isopropyl, butyl) diester; the preferred diesters are methyl diesters.

In the unsulphonated diacidic monomer (A) there may additionally be present minor quantities of aromatic diacids other than those mentioned above, such as orthophthalic acid, anthracene, 1,8-naphthalene, 1,4-naphthalene and biphenyl dicarboxylic acids or aliphatic diacids such as adipic, glutaric, succinic, trimethyladipic, pimelic, azelaic, sebacic, suberic, itaconic and maleic acids, etc. in the form of acid, anhydride or lower (methyl, ethyl, propyl, isopropyl, butyl) diesters.

The Sulphonated Diacidic Monomer (SA)

Preferably, the sulphonated diacidic monomer (SA) consists of at least one sulphonated aromatic or sulphonated aliphatic dicarboxylic acid or anhydride or lower ($C_1$–$C_4$) alkyl diester. Aromatic dicarboxylic acids and their derivatives are preferred.

Preferably, monomer (SA) is present in a quantity corresponding to a molar ratio (SA)/[(A)+(SA)] within the range of from 5:100 to 40:100, more preferably from 7:100 to 35:100.

The sulphonated diacidic monomer (SA) has at least one sulphonic acid group, preferably in the form of an alkali metal (preferably sodium) sulphonate, and two acidic functional groups or acidic functional group equivalents (that is to say an anhydride functional group or two ester functional groups) attached to one or a number of aromatic rings, when aromatic dicarboxylic acids or anhydrides or their diesters are involved, or to the aliphatic chain when aliphatic dicarboxylic acids or anhydrides or their diesters are involved.

Suitable aromatic sulphonated diacidic monomers include sulphoisophthalic, sulphoterephthalic, sulpho-orthophthalic acids or anhydrides, 4-sulpho-2,7-naphthalenedicarboxylic acids or anhydrides, sulpho 4,4'-bis (hydroxycarbonyl) diphenyl sulphones, sulphodiphenyldicarboxylic acids or anhydrides, sulpho 4,4'-bis (hydroxycarbonyl) diphenylmethanes, sulpho-5-phenoxyisophthalic acids or anhydrides or their lower (methyl, ethyl, propyl, isopropyl, butyl) diesters.

Suitable aliphatic sulphonated diacidic monomers (SA) include sulphosuccinic acids or anhydrides or their lower alkyl (methyl, ethyl, propyl, isopropyl, butyl) diesters.

The most preferred sulphonated diacidic monomer (SA) is sulphoisophthalic acid in acid, anhydride or diester (preferably dimethyl ester) form, very particularly dimethyl 5-sodiooxysulphonylisophthalate.

The Hydroxylated Diacidic Monomer (HA)

The hydroxylated diacidic monomer (HA), which is optionally present and can replace up to 50 mole %, preferably up to 30 mole %, of (A) and/or (SA), consists of least one hydroxylated aromatic or aliphatic dicarboxylic acid or anhydride or a lower (C1–C4) alkyl diester thereof.

The hydroxylated diacidic monomer (HA) has at least one hydroxyl group attached to one or a number of aromatic rings when it is an aromatic monomer or to the aliphatic chain when it is an aliphatic monomer. Aromatic monomers are preferred.

Suitable hydroxylated diacidic monomers (HA) include 5-hydroxyisophthalic, 4-hydroxyisophthalic, 4-hydroxyphthalic, 2-hydroxymethylsuccinic, hydroxymethylglutaric and hydroxyglutaric acids, in acid, anhydride or lower alkyl diester form.

The Polyol (P)

The polyol (P) may be a oligomer comprising up to 8 monomer units, preferably up to 6 and more preferably up to 4 monomer units, but is most preferably a monomer. The polyol is selected from ethylene glycol, propylene glycol, glycerol, 1,2,4-butanetriol, 1,2,3-butanetriol and combinations of these, and their lower (2 to 8, preferably 2 to 6, more preferably 2 to 4) oligomers.

Preferably, the polyol (P) is present in a quantity corresponding to a ratio of the number of OH functional groups of the polyol (P) to the number of COOH functional groups or functional group equivalents of the total diacidic monomer (A)+(SA)+(HA) within the range of from 1.05:1 to 4:1, preferably from 1.1:1 to 3.5:1 and more preferably from 1.8:1 to 3:1.

The preferred polyols (P) are ethylene glycol and glycerol, ethylene glycol being especially preferred.

Preferably, the sulphonated diacidic monomer (SA) consists of at least one sulphonated aromatic dicarboxylic acid or anhydride or of a mixture of sulphonated aromatic acids or anhydrides and of sulphonated aliphatic acids or anhydrides or their diesters when the polyol (P) does not contain any polyol other than a glycol or when the hydroxylated diacidic monomer (HA) is absent.

Molecular Weight

Preferably, the polyester used in accordance with the invention has a number average molecular weight not exceeding 20,000, and preferably not exceeding 15,000.

The molecular weight may be much lower than these limits. Polyesters having molecular weights below 1000, for example, 500–1000, have proved highly effective.

Number average molecular weight may be measured by gel permeation chromatography, for example, in dimethylacetamide containing $10^{-2}$N of LiBr, at 25° C., or in tetrahydrofuran. The results are expressed as polystyrene equivalents.

Hydroxyl Functional Group Content

Preferably, the hydroxyl functional group content of the polyester, expressed as OH equivalent/kg of polyester, is at least 0.2. The hydroxyl functional group content may be estimated from proton NMR, the measurement being carried out in dimethyl sulphoxide.

The elementary unit considered in the definition of the mole of monomer (A), (SA) or (HA) is the COOH functional group in the case of the diacids or the COOH functional group equivalent in the case of the anhydrides or of the diesters.

Especially Preferred Polyesters

An especially preferred polyester is obtainable from the following monomers:

terephthalic acid (A1) in lower alkyl (preferably methyl) diester form;

optionally isophthalic acid (A2) in acid or anhydride form;

optionally a hydroxylated terephthalic or isophthalic acid (HA) in acid or anhydride form;

the mole ratio (A1):[(A1)+(A2)] or (A1):[A1+HA)] or (A1):[(A1)+(A2)+(HA)] being within the range of from 50:100 to 100:100, preferably from 70:100 to 90:100;

sulphoisophthalic acid (SA), preferably in lower alkyl, preferably methyl, diester form; and monoethylene glycol and/or glycerol (P).

Preferred polyesters in accordance with the invention, based on terephthalic acid, isophthalic acid, sulphoisophthalic acid and monoethylene glycol, may be described as having backbone units of the following formula:

$$-\overset{O}{\overset{\|}{C}}-Ar-\overset{O}{\overset{\|}{C}}-O-(CH_2-CH_2-O)_n-$$

where Ar=terephthalic, isophthalic or sulphoisophthalic, and n represents 1, 2, 3 or 4. Typical mole percentages for the different values of n are as follows:

| | |
|---|---|
| n = 1 | 58.7 |
| n = 2 | 30.5 |
| n = 3 | 8.8 |
| n = 4 | 1.9, |

only trace quantities, if any, of polyethylene oxide units in which n is greater than four being present.

The majority of endgroups are of the formula $$-Ar-COO-(CH_2-CH_2-O-)_n$$

wherein n is 1, 2, 3 or 4, a minority being of the formulae $$-Ar-COOH \text{ or } -Ar-COOR$$

wherein R is a lower alkyl group, preferably methyl.

These polyesters, unlike many disclosed in the prior art, are not end-capped with hydrocarbon or sulphonated capping groups.

Preparation of the Polyesters

The polyesters may be prepared by the usual esterification and/or transesterification and polycondensation processes, for example, by esterification and/or transesterification in the presence of a catalyst of the polyol P with the various diacidic monomers (in acid, anhydride or diester form), and polycondensation of the polyol esters at reduced pressure in the presence of a polycondensation catalyst.

A preferred process for the preparation of the polyesters is disclosed and claimed in WO 95 32997A (Rhône-Poulenc).

Detergent Compositions

The polyesters are suitably incorporated into detergent compositions in amounts of from 0.01 to 10 wt %, preferably from 0.1 to 5 wt % and more preferably from 0.25 to 3 wt %.

The detergent compositions of the invention also contain, as essential ingredients, one or more detergent-active compounds (surfactants), and one or more detergency builders; and may optionally contain bleaching components and other active ingredients to enhance performance and properties.

The detergent-active compounds (surfactants) which may be chosen from soap and non-soap anionic, cationic, nonionic, amphoteric and zwitterionic detergent-active compounds, and mixtures thereof. Many suitable detergent-active compounds are available and are fully described in the literature, for example, in "Surface-Active Agents and Detergents", Volumes I and II, by Schwartz, Perry and Berch. The preferred detergent-active compounds that can be used are soaps and synthetic non-soap anionic and nonionic compounds. The total amount of surfactant present ranges from 2 to 50 wt %, preferably from 5 to 40 wt %.

Anionic surfactants are well-known to those skilled in the art. Examples include alkylbenzene sulphonates, particularly linear alkylbenzene sulphonates having an alkyl chain length of $C_8$–$C_{15}$; primary and secondary alkylsulphates, particularly $C_8$–$C_{15}$ primary alkyl sulphates; alkyl ether sulphates; olefin sulphonates; alkyl xylene sulphonates; dialkyl sulphosuccinates; and fatty acid ester sulphonates. Sodium salts are generally preferred.

The polymers of the present invention are especially suitable for use in compositions containing anionic sulphonate and sulphate type surfactants, for example, primary alkyl sulphates, alkyl ether sulphates, alkylbenzene sulphonates, and mixtures of these.

Nonionic surfactants that may be used include the primary and secondary alcohol ethoxylates, especially the $C_8$–$C_{20}$ aliphatic alcohols ethoxylated with an average of from 1 to 20 moles of ethylene oxide per mole of alcohol, and more especially the $C_{10}$–$C_{15}$ primary and secondary aliphatic alcohols ethoxylated with an average of from 1 to 10 moles of ethylene oxide per mole of alcohol. Non-ethoxylated nonionic surfactants include alkylpolyglycosides, glycerol monoethers, and polyhydroxyamides (glucamide).

Especially preferred are ethoxylated nonionic surfactants, alkylpolyglycosides, and mixtures of these.

As well as the non-soap surfactants listed above, detergent compositions of the invention may also advantageously contain fatty acid soap.

The detergent compositions of the invention also contain one or more detergency builders. The total amount of detergency builder in the compositions ranges from 5 to 80 wt %, preferably from 10 to 60 wt %.

An essential component of the builder system is maximum aluminium zeolite P (zeolite MAP) as described and claimed in EP 384 070B (Unilever). Zeolite MAP is defined as an alkali metal aluminosilicate of the zeolite P type having a silicon to aluminium ratio not exceeding 1.33. Especially preferred is zeolite MAP having a silicon to aluminium ratio not exceeding 1.07, more preferably about 1.00. The calcium binding capacity of zeolite MAP is generally at least 150 mg CaO per g of anhydrous material.

Zeolite MAP is preferably incorporated in amounts of from 10 to 70% by weight (anhydrous basis), more preferably from 25 to 50 wt %.

If desired, other detergent zeolites, for example, zeolite A, zeolite X or zeolite Y, may be also be present. However, zeolite MAP is preferably the only zeolite present.

Other inorganic builders that may be present include sodium carbonate, if desired in combination with a crystallisation seed for calcium carbonate, as disclosed in GB 1 437 950 (Unilever); amorphous aluminosilicates as disclosed in GB 1 473 202 (Henkel) and mixed crystalline/amorphous aluminosilicates as disclosed in GB 1 470 250 (Procter & Gamble); and layered silicates as disclosed in EP 164 514B (Hoechst). Inorganic phosphate builders, for example, sodium orthophosphate, pyrophosphate and tripolyphosphate, may also be present.

Organic builders that may be present include polycarboxylate polymers such as polyacrylates, acrylic/maleic copolymers, and acrylic phosphinates; monomeric polycarboxylates such as citrates, gluconates, oxydisuccinates, glycerol mono-, di- and trisuccinates, carboxymethyloxysuccinates, carboxymethyloxymalonates, dipicolinates, hydroxyethyliminodiacetates, alkyl- and alkenylmalonates and succinates; and sulphonated fatty acid salts. This list is not intended to be exhaustive.

Detergent compositions according to the invention may also suitably contain a bleach system, which may contain peroxy bleach compounds, for example, inorganic persalts or organic peroxyacids, capable of yielding hydrogen peroxide in aqueous solution. Suitable peroxy bleach compounds include organic peroxides such as urea peroxide, and inorganic persalts such as the alkali metal perborates, percarbonates, perphosphates, persilicates and persulphates. Preferred inorganic persalts are sodium perborate monohydrate and tetrahydrate, and sodium percarbonate. The peroxy bleach compound is suitably present in an amount of from 5 to 35 wt %, preferably from 10 to 25 wt %.

The peroxy bleach compound may be used in conjunction with a bleach activator (bleach precursor) to improve bleaching action at low wash temperatures. The bleach precursor is suitably present in an amount of from 1 to 8 wt %, preferably from 2 to 5 wt %.

A bleach stabiliser (heavy metal sequestrant) may also be present. Suitable bleach stabilisers include ethylenediamine tetraacetate (EDTA) and the polyphosphonates such as ethylenediamine tetramethylene phosphonate (EDTMP) and its salts, and diethylenetriamine pentamethylene phosphonate (DETPMP) and its salts.

The present invention is also of especial applicability to non-bleaching compositions suitable for washing delicate fabrics. Such compositions may, for example, have one or more of the following characteristics:

a 1 wt % aqueous solution pH, in demineralised water, not exceeding 10.5, and preferably not exceeding 10;

absence, or an extremely low level, of fluorescer;

presence of a polycarboxylate polymer, for example, an acrylic/maleic copolymer such as Sokalan (Trade Mark) CP5 ex BASF;

presence of a polymer effective to inhibit dye transfer, for example, polyvinyl pyrrolidone;

presence of a heavy metal sequestrant, for example, the aminomethylenephosphonic acids and salts such as EDTMP and DETPMP mentioned above in the context of bleach stabilisation.

The compositions of the invention may also contain one or more enzymes. Suitable enzymes include the proteases, amylases, cellulases and lipases usable for incorporation in detergent compositions. Detergency enzymes are commonly employed in granular form in amounts of from about 0.01 to about 5.0 wt %.

Other materials that may be present in detergent compositions of the invention include inorganic salts such as sodium carbonate, sodium sulphate or sodium silicate; antiredeposition agents such as cellulosic polymers; fluorescers; inorganic salts such as sodium sulphate; lather control agents or lather boosters as appropriate; dyes; coloured speckles; perfumes; foam controllers; and fabric softening compounds. This list is not intended to be exhaustive.

Detergent compositions of the invention may be of any suitable physical form, for example, powders or granules, liquids, gels and solid bars.

Detergent compositions of the invention may be prepared by any suitable method. Particulate detergent compositions are suitably prepared by spray-drying a slurry of compatible heat-insensitive ingredients, and then spraying on or post-dosing those ingredients unsuitable for processing via the slurry. The skilled detergent formulator will have no difficulty in deciding which ingredients should be included in the slurry and which should not.

Particulate detergent compositions of the invention preferably have a bulk density of at least 400 g/l, more preferably at least 500 g/l. Especially preferred compositions have bulk densities of at least 650 g/liter, more preferably at least 700 g/liter.

Such powders may be prepared either by post-tower densification of spray-dried powder, or by wholly non-tower methods such as dry mixing and granulation; in both cases a high-speed mixer/granulator may advantageously be used.

Processes using high-speed mixer/granulators are disclosed, for example, in EP 340 013A, EP 367 339A, EP 390 251A and EP 420 317A (Unilever).

EXAMPLES

The invention is further illustrated by the following non-limiting Examples, in which parts and percentages are by weight unless otherwise stated.

Throughout the Examples * denotes a Trade Mark.

Polymers

The polymer in accordance with the invention used (Polymer 1) was a water-soluble sulphonated polyester of terephthalic acid, isophthalic acid, sulphoisophthalic acid and ethylene glycol having the following approximate composition:

diacidic monomer comprising approximately 77 mole % terephthalate, 3.7 mole % isophthalate, 18.2 mole % sulphoisophthalate;

ratio of OH groups ex ethylene glycol to COOH groups ex diacid monomers approximately 1.22;

number average molecular weight, by GPC in tetrahydrofuran at 25° C. with calibration against polystyrene standards, 534; weight average molecular weight 1667 sulphur content 2.4 wt %;

hydroxyl group content approx. 1.4–1.5/kg polymer.

For comparative purposes, the following commercially available polymers were used:

Polymer A: Sokalan (Trade Mark) HP22 ex BASF, a graft copolymer of polyethylene glycol and polyvinyl acetate.

Polymer B: Repel-O-Tex (Trade Mark) ex Rhône-Poulenc, a PET/POET polymer, used in the form of a granule (50% wt % polymer, 50 wt % sodium sulphate).

Polymer C: Aquaperle (Trade Mark) 3991 ex ICI, a PET/POET polymer.

Example 1

Zeolite-built particulate bleaching detergent compositions of high bulk density (870 g/liter) containing zeolite MAP were prepared to the following general formulation, by non-tower granulation and postdosing techniques:

| | % |
|---|---|
| Primary alkyl sulphate (cocoPAS) | 9.17 |
| Nonionic surfactant (7E0), linear | 5.93 |
| Nonionic surfactant (3E0), iinear | 3.95 |
| Hardened tallow soap | 1.55 |
| Zeolite MAP (anhydrous basis) | 32.18 |
| Sodium citrate (2aq) | 4.25 |
| Sodium carbonate (light) | 2.30 |
| Fluorescer | 0.05 |
| Sodium carboxymethylcellulose (70%) | 0.88 |
| Sodium percarbonate ($AvO_2$ 13.25) | 20.50 |
| TAED (83% granule) | 6.50 |
| EDTMP (Dequest* 2047) | 0.42 |
| Protease (Maxacal* CX600k 2019 GU/mg) | 1.50 |
| Lipase (Lipolase* 100T 287 LU/mg) | 0.25 |
| Amylase (Termamyl* 60T 4.3 MU/mg) | 0.05 |
| Antifoam/fluorescer granule | 4.00 |
| Sodium bicarbonate | 1.00 |
| Perfume | 0.45 |
| Soil release polymer (see below) | 0 or 0.40 |
| Minor ingredients | to 100.00 |

The zeolite MAP was Doucil* A24 ex Crosfield Chemicals; the zeolite A was Wessalith* P ex Degussa.

Soil release and detergency were measured using radio ($^3H$)-labelled triolein as a soil. The wash regime was as follows: polyester cloths were washed for 20 minutes in Tergotometers in the test formulations (with or without soil release polymer at 0.4 wt %), at the product dosages stated, at 40° C. in 24°FH (calcium only) water.

Single wash: soiled cloths were washed as described above.

Prewash: as single wash but no soil present; after prewash the fabrics were rinsed in a beaker with 1 liter of water at 20° C. and dried overnight.

Main wash: as for single wash but using pretreated fabrics.

Detergency Results

Product dosage: 4.8 g/liter

| Polymer | % Detergency | |
|---|---|---|
| (0.4 wt %) | Single wash | Prewash + main wash |
| None | 15.6 | 5.3 |
| Polymer 1 | 76.9 | 87.5 |
| Polymer A | 18.5 | 7.9 |
| Polymer B | 39.8 | 62.3 |
| Polymer C | 44.9 | 69.9 |

Example 2, Comparative Example A

In this Example, the effects of Polymers 1 and B in formulations built with zeolite MAP and with zeolite A were compared.

Ingredients were dosed separately into tergotometers to give the following formulations:

| | parts by weight | |
|---|---|---|
| | A | 2 |
| Primary alkyl sulphate (cocoPAS) | 9.17 | 9.17 |
| Nonionic surfactant (6.5E0), linear | 5.93 | 5.93 |
| Nonionic surfactant (3E0), linear | 3.95 | 3.95 |
| Sodium carbonate | 18.00 | 18.00 |
| Sodium bicarbonate | 1.00 | 1.00 |
| Zeolite MAP (anhydrous basis) | — | 32.00 |
| Zeolite A (anhydrous basis) | 32.00 | — |
| Sodium citrate (2aq) | 4.25 | 4.25 |
| Soil release polymer | 0 or 1.00 | 0 or 1.00 |

Soil release and detergency on polyester cloths soiled with radio($^3$H)-labelled triolein were measured, as in Example 1, using the single-wash regime described in Example 1 (20 minutes, 40° C., 24°FH (calcium only) water). The "product" dosage was 4 g/l. Results were as follows:

| | Example A (zeolite A) | Example 2 (zeolite MAP) | % change (2 − A) |
|---|---|---|---|
| No polymer | 9.8 | 11.5 | +1.7 |
| Polymer 1 | 66.0 | 67.2 | +1.2 |
| Polymer B | 58.5 | 46.9 | −11.6 |

It will be noted that the performance of Polymer 1 is good in both the zeolite-A-built and zeolite-MAP-built formulations, but especially good in the latter. Polymer B gave a significantly poorer performance in the zeolite-MAP-built formulation.

Example 3, Comparative Example B

The procedure of Example 2 and Comparative Example A was repeated with a different formulation:

| | parts by weight | |
|---|---|---|
| | B | 3 |
| Linear alkylbenzene sulphonate | 8.91 | 8.91 |
| Nonionic surfactant (6.5E0), branched | 4.69 | 4.69 |
| Nonionic surfactant (3E0), branched | 2.50 | 2.50 |
| Sodium carbonate | 22.76 | 22.76 |
| Sodium bicarbonate | 1.00 | 1.00 |
| Zeolite MAP (anhydrous basis) | — | 28.51 |
| Zeolite 4A (anhydrous basis) | 28.51 | — |
| Soil release polymer | 0 or 1.00 | 0 or 1.00 |

Soil release and detergency were measured as described in Example 2, the product dosage being 4 g/l.

| | Example B (zeolite A) | Example 3 (zeolite MAP) | % change (3 − B) |
|---|---|---|---|
| No Polymer | 21.4 | 10.5 | −10.9 |
| Polymer 1 | 84.8 | 69.2 | −15.6 |
| Polymer B | 58.6 | 33.3 | −25.3 |

With this combination of ingredients, the zeolite-MAP-built formulation was always inferior to the corresponding zeolite-A-built formulation, but the negative was smaller, and the absolute detergency much higher, when Polymer 1 was present.

Example 4

An example of a zeolite-built high bulk density particulate non-bleaching detergent composition in accordance with the invention, especially suitable for washing coloured fabrics, is as follows:

| | % |
|---|---|
| Primary alkyl sulphate (coaoPAS) | 6.34 |
| Nonionic surfactant (7E0), linear | 14.26 |
| Hardened tallow soap | 2.21 |
| Zeolite MAP (anhydrous basis) | 40.14 |
| Sodium carbonate (light) | 1.26 |
| SCMC | 0.98 |
| Granular sodium citrate (2aq) | 21.93 |
| Antifoam/PVP granule | 3.15 |
| EDTMP (Dequest* 2047) | 1.43 |
| Protease (Savinase* 6.0T 1635 GU/mg) | 1.20 |
| Lipase (Lipolase* 100T 287 LU/mg) | 0.28 |
| Amylase (Termamyl* 60T 4.3 MU/mg) | 0.06 |
| Perfume | 0.45 |
| Soil release polymer | 0.40 |
| Moisture etc | to 100.00 |

The bulk density of this formulation is 890 g/liter, and the 1 wt % aqueous solution pH in demineralised water at 25° C. is 10.5.

We claim:

1. A detergent composition for washing fabrics, comprising (a) from 2 to 50 wt % of an organic surfactant system comprising one or more anionic, nonionic, cationic, amphoteric or zwitterionic surfactants;

(b) from 5 to 80 wt % of a builder system comprising alkali metal aluminosilicate;

(c) a soil release effective amount of a water-soluble or water-dispersible soil release polymer, (d) optionally other detergent ingredients to 100 wt %, characterised in that the alkali metal aluminosilicate builder (b) is zeolite P having a silicon to aluminium ratio not exceeding 1.33 (zeolite MAP), and the soil release polymer (c) comprises a water-soluble or water-dispersible non-end-capped sulphonated polyester comprising consisting essentially of monomer units of (i) an unsulphonated aromatic diacidic monomer (A), (ii) a sulphonated aromatic diacidic monomer (SA), (iii) optionally a hydroxylated aromatic or aliphatic diacidic monomer (HA), in an amount replacing up to 50 mole % of (A) and/or (SA), (iv) a polyol (P) selected from ethylene glycol, propylene glycol, isopropylene glycol, glycerol, 1,2,4-butanetriol and 1,2,3-butanetriol, and oligomers of these having from 1 to 8 monomer units, the polyester having a sulphur content within the range of from 0.5 to 10 wt %.

2. A detergent composition as claimed in claim 1, characterised in that it comprises from 0.01 to 10 wt % of the polyester (c).

3. A detergent composition as claimed in claim 2, characterised in that it comprises from 0.1 to 5 wt % of the polyester (c).

4. A detergent composition as claimed in claim 1, characterised in that the organic surfactant system comprises a sulphate or sulphonate type anionic surfactant optionally in combination with a nonionic surfactant.

5. A detergent composition as claimed in claim 4, characterised in that the anionic surfactant comprises primary alkyl sulphate and/or alkyl ether sulphate and/or alkylbenzene sulphonate.

6. A detergent composition as claimed in claim 1, characterised in that the organic surfactant system comprises an ethoxylated nonionic surfactant and/or an alkylpolyglycoside.

7. A detergent composition as claimed in claim 1, characterised in that it comprises a bleach system comprising from 5 to 35 wt %, based on the detergent composition, of sodium percarbonate.

8. A detergent composition as claimed in claim 1, characterised in that it has a 1 wt % solution pH in demineralised water at 25° C. not exceeding 10.5.

9. A detergent composition as claimed in claim 1, characterised in that it is particulate and has a bulk density of at least 650 g/liter.

* * * * *